US012515119B2

(12) United States Patent
Tseng

(10) Patent No.: US 12,515,119 B2
(45) Date of Patent: Jan. 6, 2026

(54) FLIP-OVER MECHANISM

(71) Applicant: Bingotimes Digital Technology Co., Ltd., Taichung (TW)

(72) Inventor: Kuo-Lung Tseng, Taichung (TW)

(73) Assignee: Bingotimes Digital Technology Co., Ltd., Taichung (TW)

( * ) Notice: Subject to any disclaimer, the term of this patent is extended or adjusted under 35 U.S.C. 154(b) by 511 days.

(21) Appl. No.: 18/139,339

(22) Filed: Apr. 25, 2023

(65) Prior Publication Data

US 2024/0359085 A1 Oct. 31, 2024

(51) Int. Cl.
*A63F 1/06* (2006.01)

(52) U.S. Cl.
CPC ..... *A63F 1/067* (2013.01)

(58) Field of Classification Search
CPC .... A63F 1/067; A63F 1/10; A63F 1/12; A63F 1/16
See application file for complete search history.

(56) References Cited

U.S. PATENT DOCUMENTS

| | | | | |
|---|---|---|---|---|
| 4,807,884 A * | 2/1989 | Breeding | A63F 1/12 273/149 R |
| 7,874,559 B1 * | 1/2011 | Tseng | A63F 1/12 273/149 R |
| 7,971,881 B2 * | 7/2011 | Toyama | A63F 1/12 209/547 |
| 2015/0238848 A1 * | 8/2015 | Kuhn | A63F 1/12 273/149 R |

FOREIGN PATENT DOCUMENTS

CN 103055499 A * 4/2013

* cited by examiner

*Primary Examiner* — Michael D Dennis
(74) *Attorney, Agent, or Firm* — Che-Yang Chen

(57) ABSTRACT

A flip-over mechanism includes a frame, a flipping plate pivotally connected to the frame, and a tray. A first connecting rod and a second connecting rod are pivotally connected to the frame. The flipping plate is configured to receive a playing plate. A connecting lever, a first push handle and a second push handle are pivotally connected to the flipping plate. The other end of the connecting lever is pivotally connected to the tray. One side of the tray is pivotally connected to the flipping plate. The turning disc drives the connecting lever to push the flipping plate to turn upwards, the first push handle is driven by the first connecting rod to push the playing card, and the second push handle is driven by the second connecting rod to push the tray to turn upwards, such that the playing card is pushed into the tray.

10 Claims, 6 Drawing Sheets

FLIP-OVER MECHANISM

BACKGROUND OF THE PRESENT INVENTION

Field of Invention

The present invention relates to a flip-over mechanism, and more particularly to a flip-over mechanism having a flipping plate and a tray to flip, by 180 degrees, a playing card, without any manual operation.

Description of Related Arts

In general, an electronic poker game machine is automated when playing games. The electronic poker game machine uses an automatic shuffling machine to shuffle playing cards automatically, and uses the suction cup of a robotic arm to pick one of the playing cards from the automatic shuffling machine. The robotic arm moves the picked playing card to a photographic identifier to identify the suit and the numeral of the playing card. Then, the information about the suit and the numeral of the playing card read by the electronic poker game machine is sent to each player. Therefore, it can be completely free from manual operation and manual contact, so as to achieve the fairness of the game. However, if one of the playing cards is not flat in the process of shuffling the playing cards, the corner of the playing card will be jammed, which results in that the playing card is placed incorrectly, that is, the front having the suit and the numeral of the playing card faces up, and the back of the playing card faces down. After the robotic arm picks up the playing card, the photographic identifier cannot identify the playing card. At this time, it is necessary to flip over the playing card manually for the front of the playing card to face down for identification, otherwise the electronic poker game cannot be continued. However, human intervention is required to resolve emergencies while the electronic poker game is in progress, which may lead to the following problems:

1. Game fairness: If human intervention is required to flip over the playing card, this may bring questions about the fairness of the game. Players may perceive that manual intervention interferes with the game outcome and may cause players to distrust the game, which in turn affects the credibility of the operator.

Manual operation cost: If human intervention is required to flip over the playing card, human resources are required to supervise and perform this task. This will increase operating costs, which in turn will affect operating earnings.

SUMMARY OF THE PRESENT INVENTION

The primary object of the present invention is to solve the aforesaid problems and to provide a flip-over mechanism. The flip-over mechanism has a flipping plate and a tray to flip, by 180 degrees, a playing card, without any manual operation.

In order to achieve the foregoing object, a flip-over mechanism is provided. The flip-over mechanism comprises a frame, a flipping plate, and a tray. The frame includes a horizontal plate and a turning disc under the horizontal plate. The turning disc is driven to rotate by an external power. The turning disc has a shaft pin on a periphery thereof. A pair of pivot ears is provided on one side of the frame. One end of a first connecting rod and one end of a second connecting rod are pivotally connected to the horizontal plate, respectively. The flipping plate includes a plate shaft portion on one side thereof, a pair of shaft seats, and a trough. The plate shaft portion is pivotally connected to the pair of pivot ears. The trough is located at one side of the pair of shaft seats away from the plate shaft portion and configured for receiving a playing card. A slot is defined in the trough. The flipping plate has a through hole between the plate shaft portion and the pair of shaft seats. A connecting seat and a pivot seat are coupled to an underside of the flipping plate. One end of a connecting lever is pivotally connected to the connecting set. Another end of the connecting lever is pivotally connected to the pivot pin of the turning disc. A first push handle and a second push handle are pivotally connected to the pivot seat. The first push handle has a first push arm facing the slot. The first push handle is driven by another end of the first connecting rod to pivot the first push arm. The second push handle has a second push arm facing the through hole. The second push handle is driven by another end of the second connecting rod to pivot the second push arm. The tray includes a tray shaft portion on one side thereof. The tray shaft portion is pivotally connected to the pair of the shaft seats. The turning disc is driven to rotate for the connecting lever to push the flipping plate to turn upwards, the first push arm is driven by the first connecting rod to pass through the slot and push the playing card, and the second push arm is driven by the second connecting rod to pass through the through hole and push the tray to turn upwards, such that the playing card is pushed into the tray.

In one embodiment of the present invention, a vertical fixing base is provided under the horizontal plate. A motor and a proximity switch are coupled to the fixing base and configured to drive the turning disc to rotate.

In one embodiment of the present invention, the periphery of the turning disc has a protruding portion. The protruding portion is turned to be aligned with or not to be aligned with the proximity switch along with rotation of the turning disc, so as to control rotation of the turning disc.

In one embodiment of the present invention, an included angle is formed between axial extension lines of the plate shaft portion and the tray shaft portion.

In one embodiment of the present invention, a guide slope is provided on one side of the trough, away from the pair of shaft seats. A side baffle is provided on one side of the flipping plate, adjacent to the guide slope.

In one embodiment of the present invention, a stop protrusion is provided between the pair of shaft seats and the trough. A positioning protrusion is provided close to one side of the tray shaft portion and corresponds to the stop protrusion. The positioning protrusion is configured to be in contact with the stop protrusion, so that the tray is pivoted and positioned at a predetermined angle.

In one embodiment of the present invention, the first push handle has a first fulcrum portion that is pivotally connected to the pivot seat, a first drive arm on one side of the first fulcrum portion, and a first push arm on another side of the first fulcrum portion. An outer end of the first drive arm is pivotally to the another end of the first connecting rod. The second push handle has a second fulcrum portion that is pivotally connected to the pivot seat, a second drive arm on one side of the second fulcrum portion, and a second push arm on another side of the second fulcrum portion. An outer end of the second drive arm is pivotally to the another end of the second connecting rod.

In one embodiment of the present invention, the pivot seat is in an inverted "U" shape. The pivot seat has a first pivot portion on one side thereof and a second pivot portion on an opposing side thereof. The first pivot portion is pivotally connected to the first fulcrum portion. The second pivot portion is pivotally connected to the second fulcrum portion.

In one embodiment of the present invention, each of the first push arm and the second push arm is in the form of an arc hook having one end portion tilted upwardly.

In one embodiment of the present invention, the end portions of the first push arm and the second push arm are pushed upwardly in different directions. A pivotal position of the first connecting rod and the first drive arm is higher in height than the first fulcrum portion. A pivotal position of the second connecting rod and the second drive arm is lower in height than the second fulcrum portion.

With the flip-over mechanism, the playing card can be flipped by 180 degrees to achieve an automatic flip function, so as to correct the playing card that is placed incorrectly.

DETAILED DESCRIPTION OF THE PREFERRED EMBODIMENT

Figure 1:
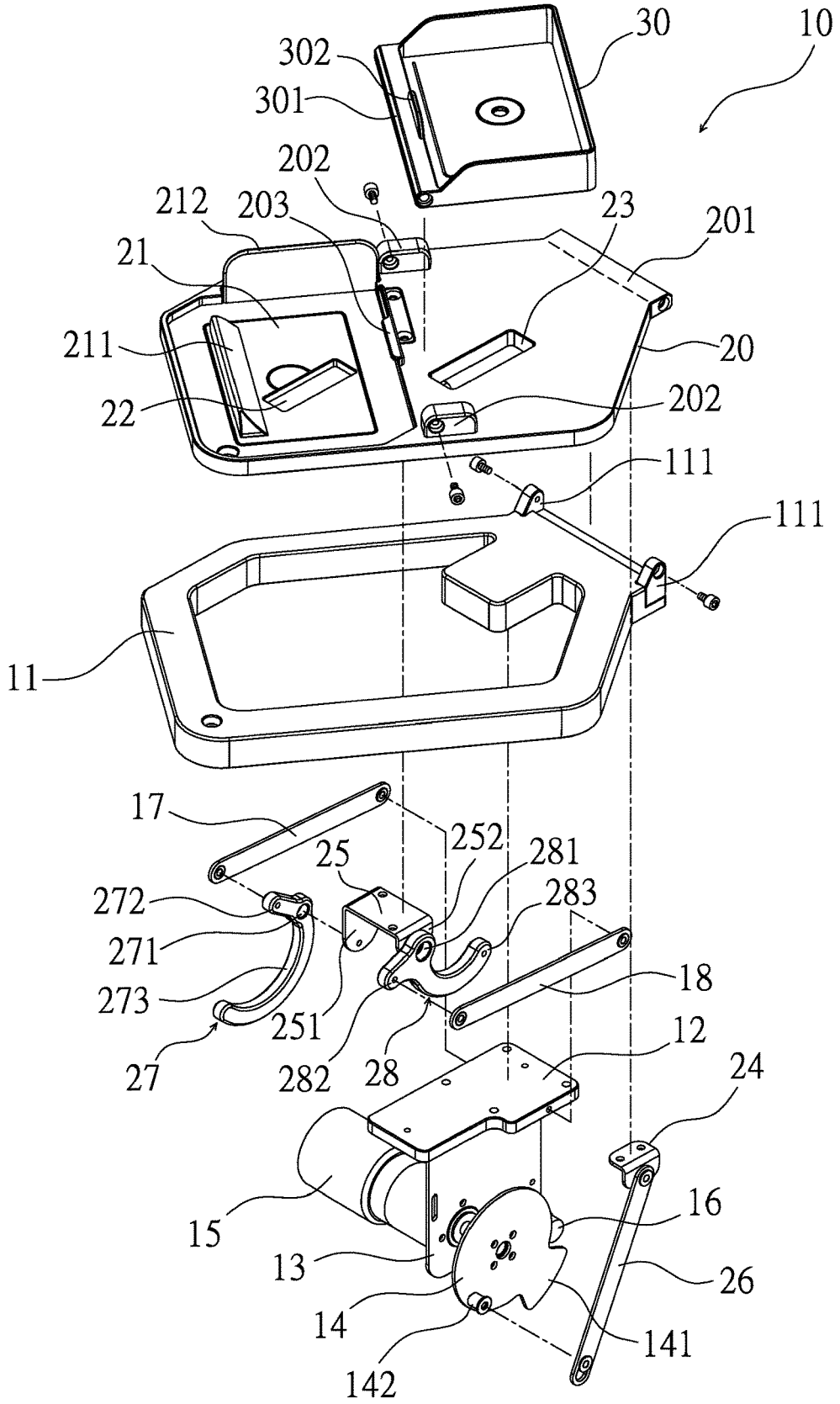
FIG. 1 is an exploded view of the present invention.
Figure 2:
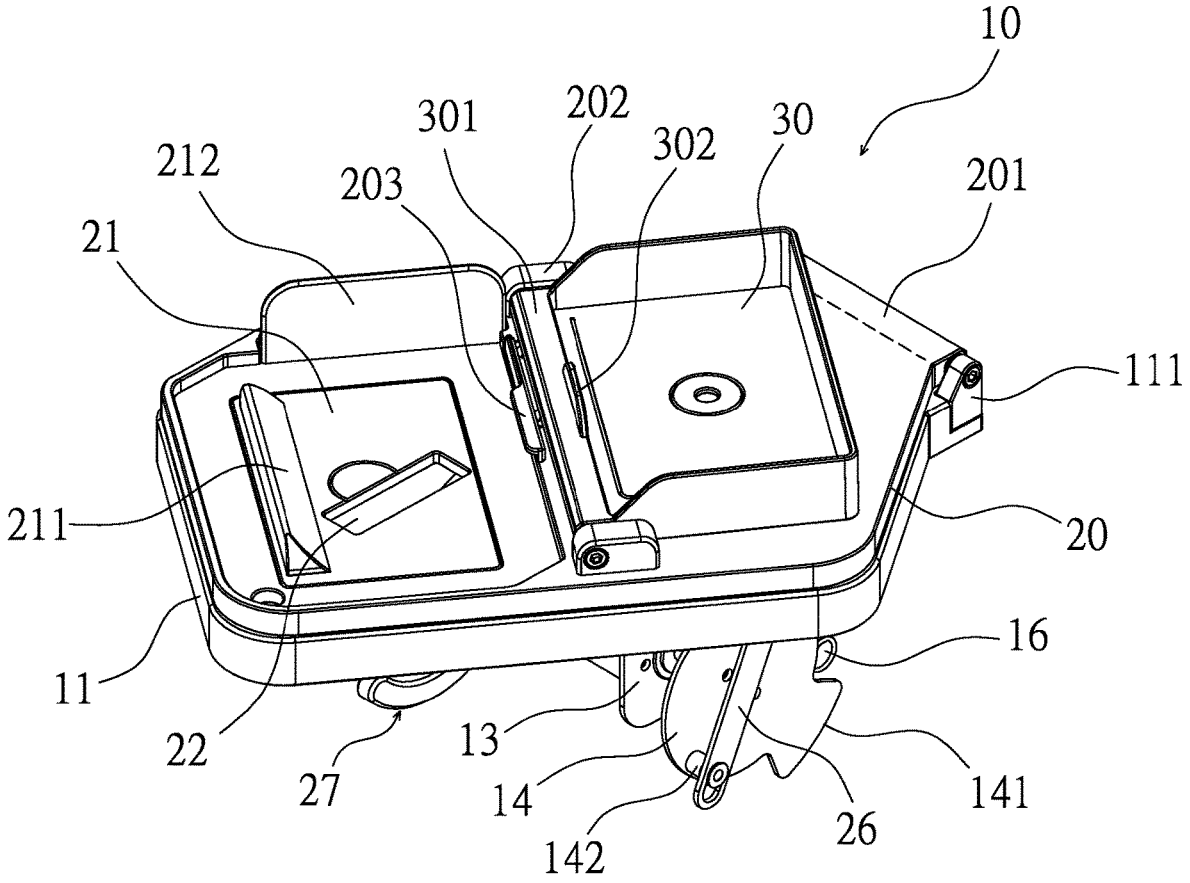
FIG. 2 is a perspective view of the present invention.
Figure 3:
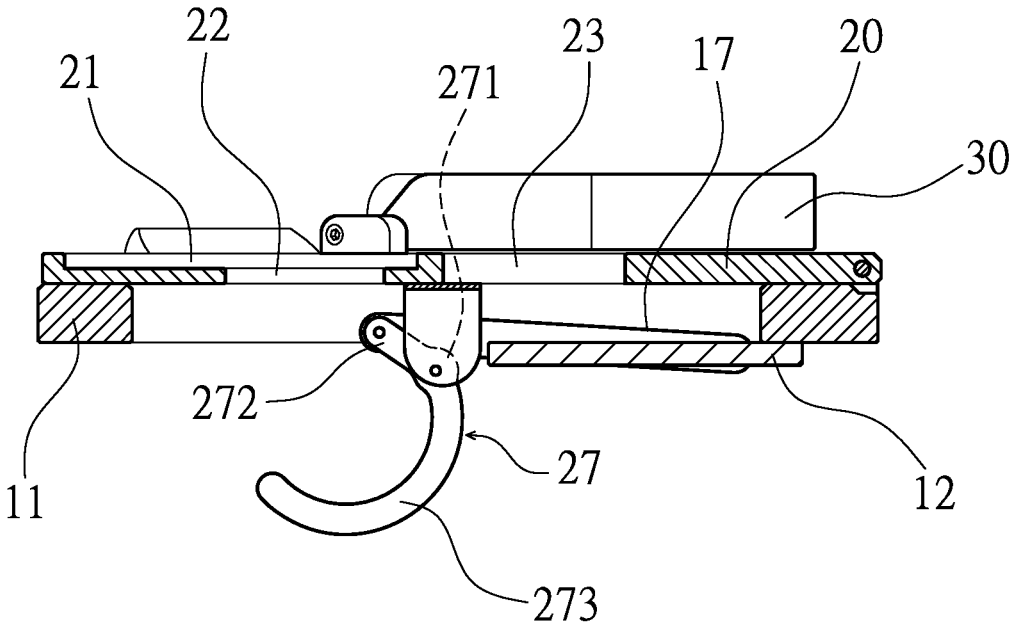
FIG. 3 is a side cross-sectional view of the present invention, illustrating the position of the first connecting rod.

Embodiments of the present invention will now be described, by way of example only, with reference to the accompanying drawings.

Referring to FIGS. 1 to 7, a flip-over mechanism 10, comprises a frame 11, a flipping plate 20, and a tray 30.

The frame 11 includes a horizontal plate 12, a vertical fixing base 13 under the horizontal plate 12, a motor 15 and a proximity switch 16. The motor 15 and the proximity switch 16 are coupled to the fixing base 13 and configured to drive a turning disc 14 to rotate. The periphery of the turning disc 14 has a protruding portion 141 and a shaft pin 142. The protruding portion 141 is turned to be aligned with or not to be aligned with the proximity switch 16 along with rotation of the turning disc 14. A pair of pivot ears 111 is provided on one side of the frame 11. One end of a first connecting rod 17 and one end of a second connecting rod 18 are pivotally connected to the horizontal plate 12, respectively. The first connecting rod 17 and the second connecting rod 18 are parallel to each other.

The flipping plate 20 includes a plate shaft portion 201 on one side thereof and a trough 21. The plate shaft portion 201 is pivoted to the pair of pivot ears 111. The axial direction of the plate shaft portion 201 is perpendicular to the first connecting rod 17 and the second connecting rod 18. The trough 21 is located at one side of the pair of shaft seats 202 away from the plate shaft portion 201. A stop protrusion 203 is provided between the pair of shaft seats 202 and the trough 21. A guide slope 211 is provided on one side of the trough 21, away from the pair of shaft seats 202. A side baffle 212 is provided on one side of the flipping plate 20 adjacent to the guide slope 211. A slot 22 is defined in the trough 21. The flipping plate 20 has a through hole 23 between the plate shaft portion 201 and the pair of shaft seats 202. A connecting seat 24 and a pivot seat 25 are coupled to the underside of the flipping plate 20. One end of a connecting lever 26 is pivotally connected to the connecting set 24, and the other end of the connecting lever 26 is pivotally connected to the pivot pin 142 of the turning disc 14. The pivot seat 25 is in an inverted "U" shape to form a first pivot portion 251 on one side thereof and a second pivot portion 252 on an opposing side thereof. A first push handle 27 is pivotally connected to the first pivot portion 251. A second push handle 28 is pivotally connected to the second pivot portion 252. The first push handle 27 has a first fulcrum portion 271 that is pivotally connected to the first pivot portion 251 and is free to rotate, a first drive arm 272 on one side of the first fulcrum portion 271, and a first push arm 273 on the other side of the first fulcrum portion 271. An outer end of the first drive arm 272 is pivotally to the other end of the first connecting rod 17. The second push handle 28 has a second fulcrum portion 281 that is pivotally connected to the second pivot portion 252 and is free to rotate, a second drive arm 282 on one side of the second fulcrum portion 281, and a second push arm 283 on the other side of the second fulcrum portion 281. An outer end of the second drive arm 282 is pivotally to the other end of the second connecting rod 18. Each of the first push arm 273 and the second push arm 283 is in the form of an arc hook having one end portion tilted upwardly. The end portions of the first push arm 273 and the second push arm 283 are pushed upwardly in different directions. The end portion of the first push arm 273 faces the slot 22. The end portion of the second push arm 283 faces the through hole 23. The pivotal position of the first connecting rod 17 and the first drive arm 272 is higher in height than the first fulcrum portion 271. The pivotal position of the second connecting rod 18 and the second drive arm 282 is lower in height than the second fulcrum portion 281. The first push arm 273 can be pivoted to pass through the slot 22 and extend out of the trough 21. The second push arm 283 can be pivoted to pass through the through hole 23 and extend out of the flipping plate 20.

The tray 30 includes a tray shaft portion 301 on one side thereof and a positioning protrusion 302. The tray shaft portion 301 is pivotally connected to the pair of shaft seats 202. The axial extension lines of the plate shaft portion 201 and the tray shaft portion 301 are not parallel to each other and form an included angle θ. The positioning protrusion 302 is located close to one side of the tray shaft portion 301 and corresponds to the stop protrusion 203. When the tray 30 is pivoted to be aligned with the trough 21, the positioning protrusion 302 is in contact with the stop protrusion 203, so that the tray 30 is pivoted and positioned at a predetermined angle.

With the above mechanism, when a playing card 1 is placed in the trough 21 incorrectly, the turning disc 14 drives the flipping plate 20 to turn upwards and drives the first push handle 27 and the second push handle 28 to pivot, such that the first push arm 273 pushes the playing card 1, and the second push arm 283 pushes the tray 30 to turn upwards, and the playing card 1 is pushed into the tray 30. Then, the tray 30 is returned horizontally, and the front and the back of the playing card 1 are exchanged, so that the playing card can be flipped over automatically.

Figure 4:
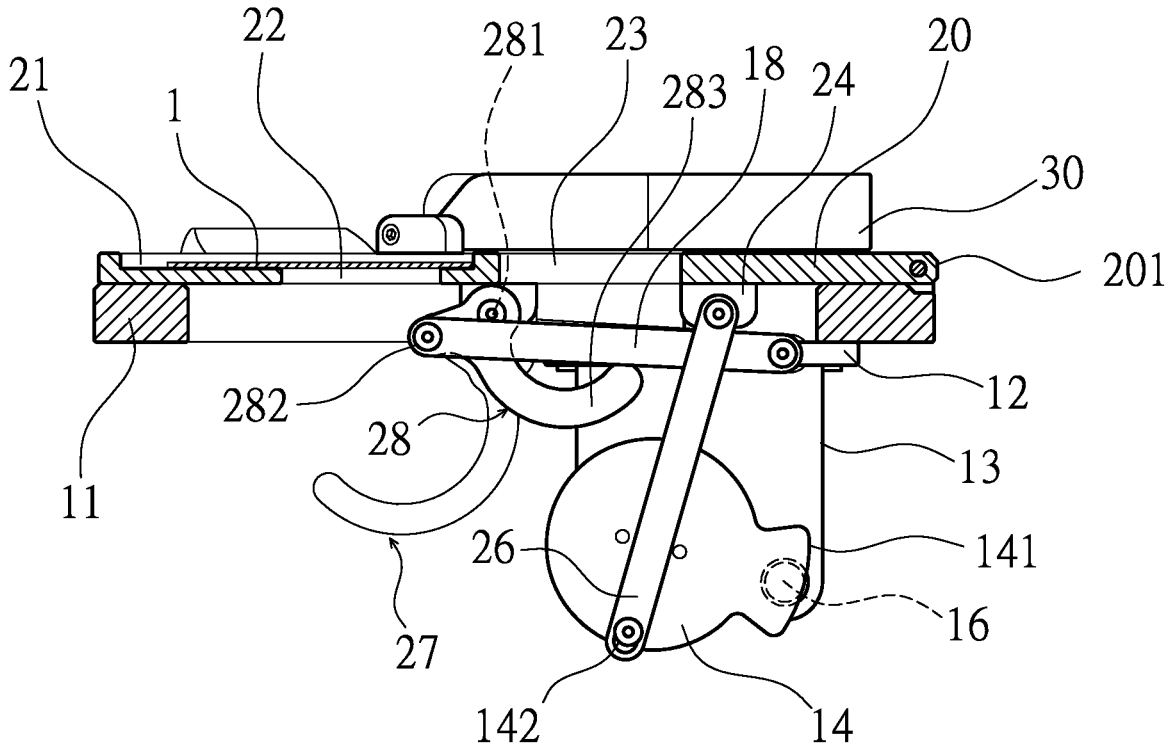
FIG. 4 is a side cross-sectional view of the present invention, illustrating the position of the second connecting rod.
Figure 5:
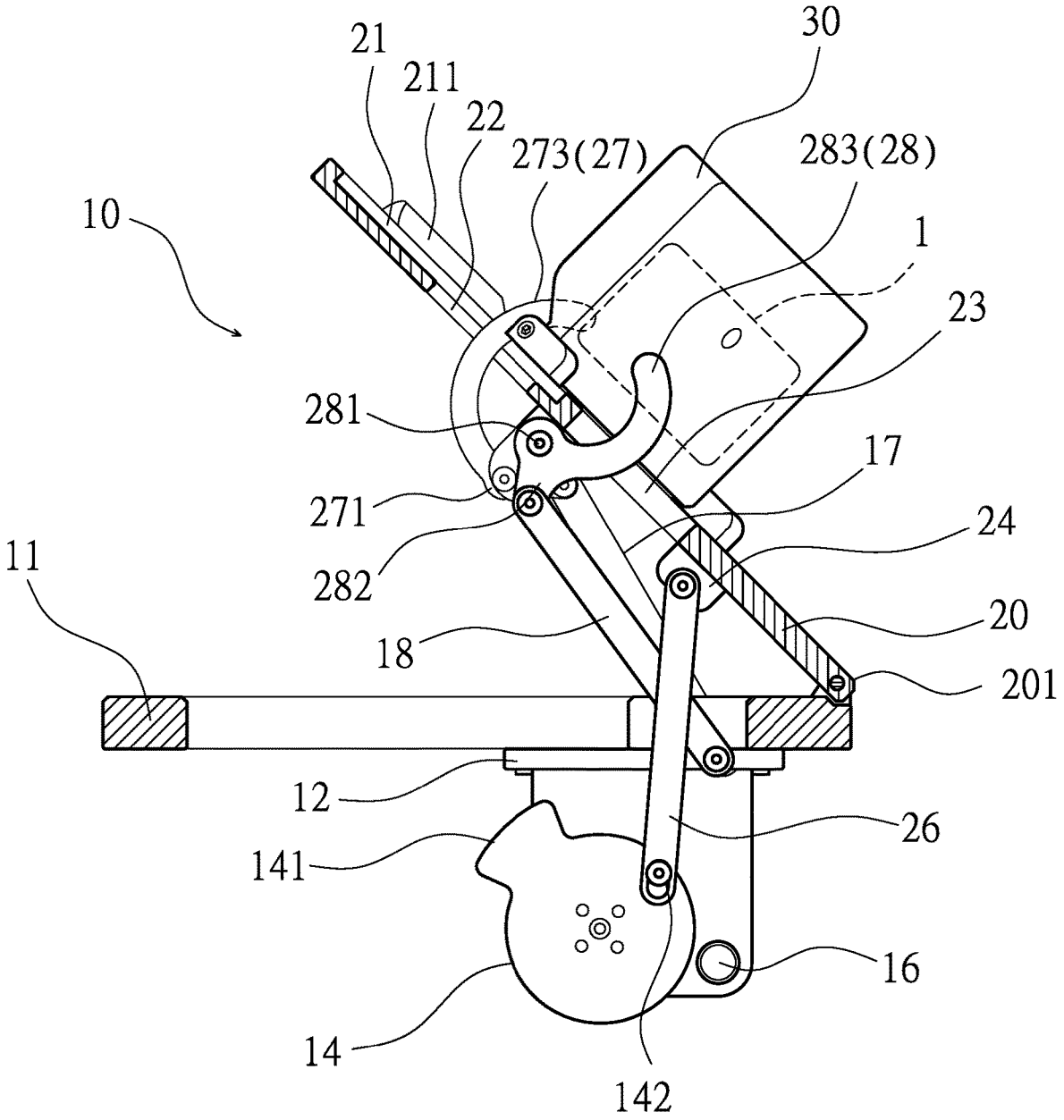
FIG. 5 is a side cross-sectional view of the present invention, illustrating that the flipping plate and the tray are tilted upwards.
Figure 6:
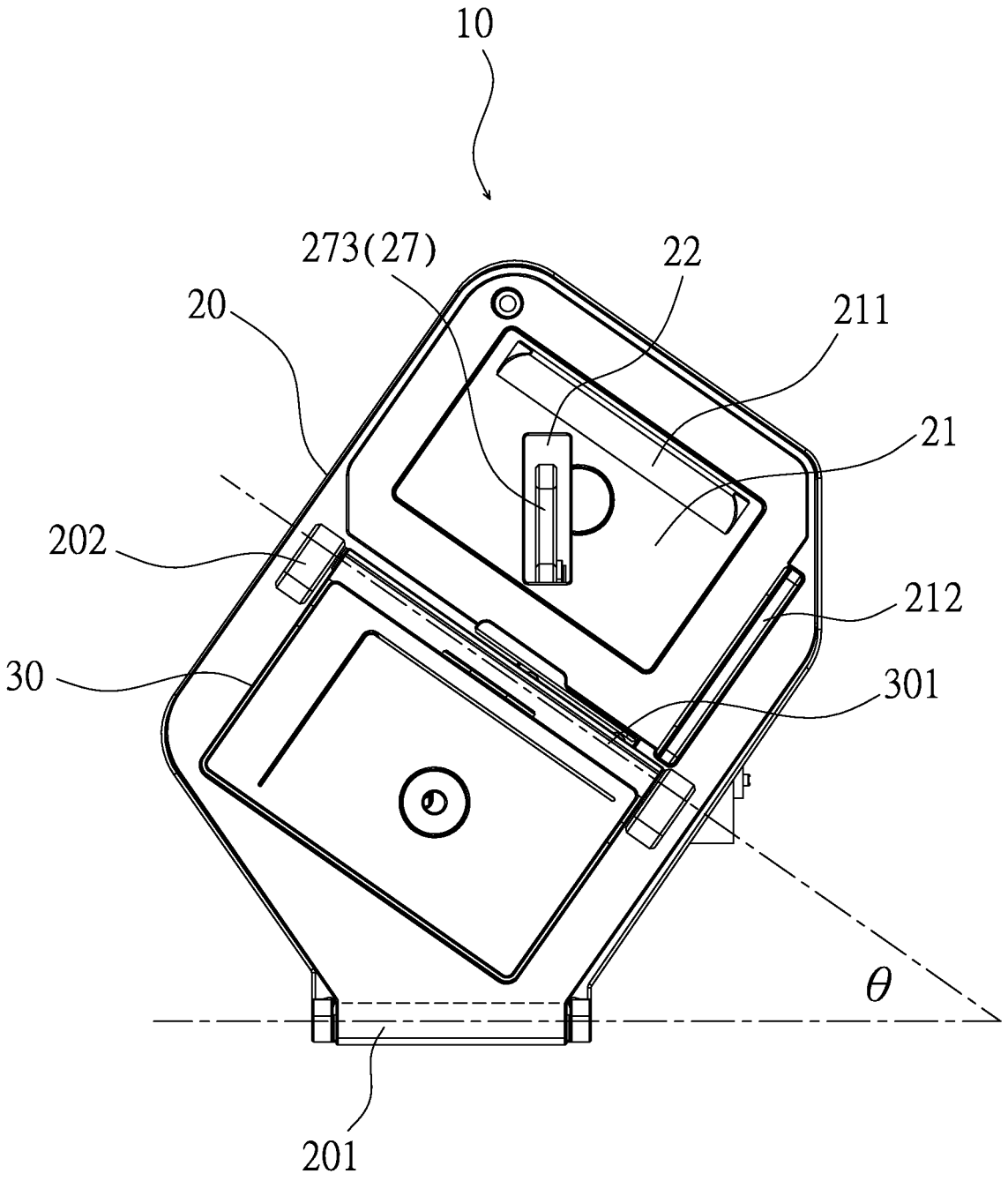
FIG. 6 is a top view of the present invention.
Figure 7:
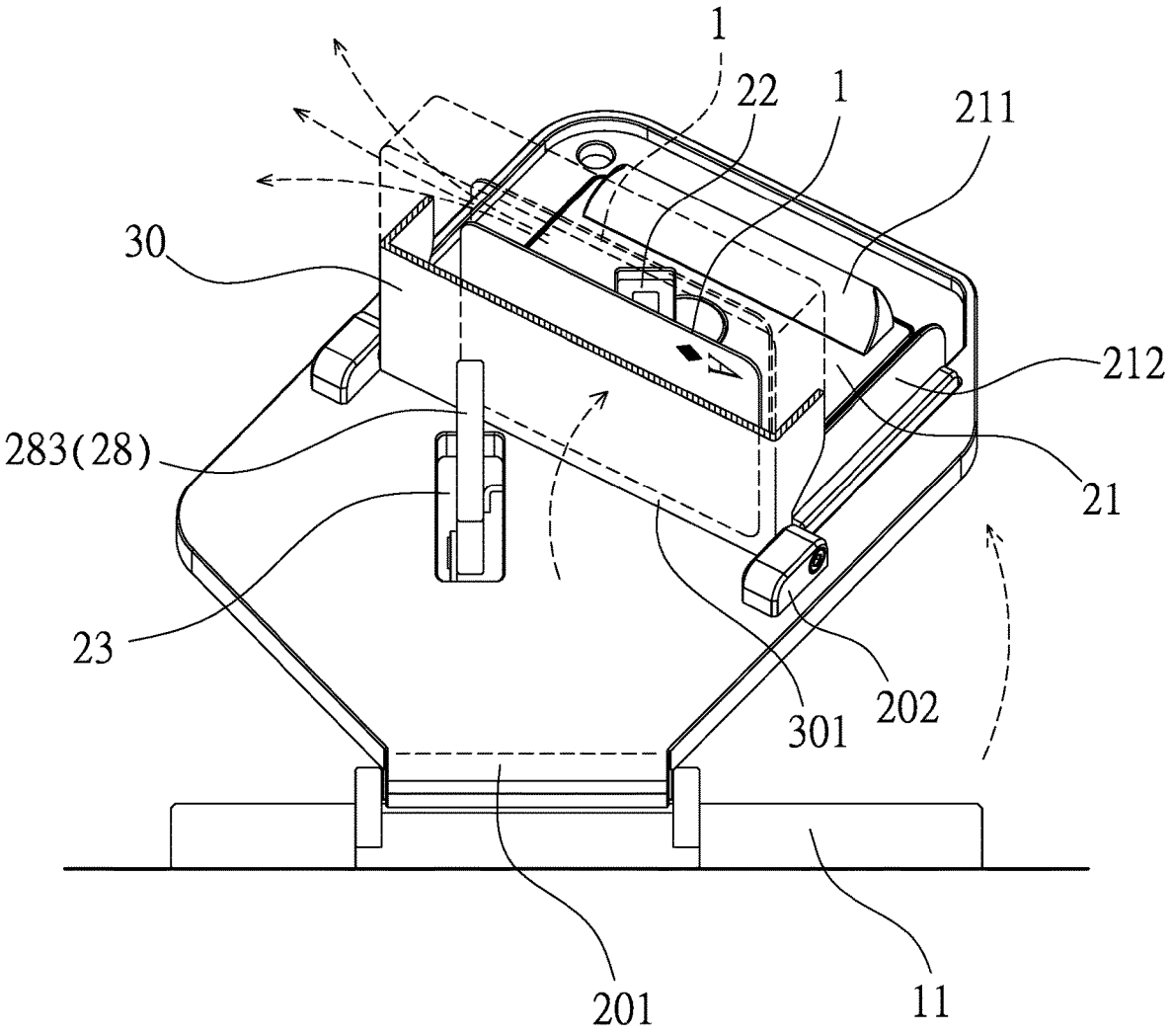
FIG. 7 is a schematic view of the present invention when in use, wherein the airflow between the playing card and the tray is discharged and the playing card falls into the tray at an angle of inclination.

The assembly, function and effect of the present invention are described in detail below. As shown in FIGS. 1 to 7, the frame 11 of the flip-over mechanism 10 is fixed to the table top of an electronic game machine, which is beneficial for a robot arm or other automatic mechanism to place and take playing cards. The flip-over mechanism 10 is electrically connected to the electronic game machine, so that the operation of the flip-over mechanism 10 can be controlled to facilitate automatic operation. In the present invention, the position of the trough 21 is on the outer side of the flipping plate 20 that is farther away from the plate shaft portion 201 relative to the tray 30, and the axial extension lines of the plate shaft portion 201 and the tray shaft portion 301 are not parallel and intersects at an angle θ. When the flipping plate 20 is turned upwards, the trough 21 and the tray 30 are obliquely inclined, and the tray 30 is turned upwards at an angle of inclination (as shown in FIG. 6 and FIG. 7). In this way, when the playing card 1 in the trough 21 is aligned with the tray 30, the playing card 1 is pushed into the tray 30 by the first push arm 273 at an angle of inclination. The airflow between the playing card 1 and the tray 30 is discharged smoothly from the direction of the opening to reduce the wind resistance. Furthermore, the playing card 1 falls into the tray 30 at an angle of inclination. The playing card 1 will resist the wind resistance directly if it is flipped by 90 degrees, so the air between the playing card 1 in the trough 21 and the tray 30 directly collides instantly to generate turbulent flow. The large wind resistance makes the motor 15 that drives the flipping plate 20 to turn be loaded heavily. Besides, the turbulent flow will cause the playing card 1 to fly randomly. As a result, the playing card 1 may fall out of the tray 30.

When an electronic poker game is playing and a playing card 1 is placed incorrectly by mistake, a robot arm or other automatic mechanism is used to place the playing card 1 in the trough 21 of the flip-over mechanism 10. Initially, the proximity switch 16 corresponds to the outer protruding portion 141 as the turning disc 14 rotates (as shown in FIG. 4). At this time, the pivot pin 142 of the turning disc 14 pulls down the connecting lever 26 to the bottom dead point, so that the flipping plate 20 and the tray 30 are in a horizontal state. Then, the motor 15 drives the turning disc 14 to rotate (in this embodiment, it rotates counterclockwise, but not limited to this), so that the protruding portion 141 leaves the position of the proximity switch 16, as shown in FIG. 5. At this time, the proximity switch 16 senses that the turning disc 14 starts to rotate. When the turning disc 14 rotates about half a circle, that is, the pivot pin 142 pushes the connecting lever 26 up to the top dead point, the plate shaft portion 201 of the flipping plate 20 serves as the rotating shaft, and the distance between the plate shaft portion 201 and the connecting seat 24 is defined as the moment arm, and the connecting lever 26 pushes the flipping plate 20 upwards by an angle. The first push handle 27 and the second push handle 28 are lifted upwards simultaneously along with the flipping plate 20. Because one end of the first connecting rod 17 and one end of the second connecting rod 18 are pivotally connected to the horizontal plate 12, the first connecting rod 17 having a fixed length generates a pulling force at the side of the first fulcrum portion 271 to the first drive arm 272. Because the pivotal position of the first connecting rod 17 is higher than the first fulcrum portion 271, the first push handle 27 is rotated in a clockwise direction, and the first push arm 273 is driven to pass through the slot 22 from the bottom of the flipping plate 20 to extend out of the trough 21 to lift the playing card 1. At the same time, the second connecting rod 18 having a fixed length generates a pulling force at the side of the second fulcrum portion 281 to the second drive arm 282. Because the pivotal position of the second connecting rod 18 is lower than the second fulcrum portion 281, the second push handle 28 is rotated in a counterclockwise direction, and the second push arm 283 is driven to pass through the through hole 23 from the bottom of the flipping plate 20 and extend out of the flipping plate 20 to lift the tray 30. At the same time, the tray shaft portion 301 of the tray 30 serves as a rotating shaft, and the tray 30 is pivoted upwards at an angle of inclination to face the trough 21, so as to receive the playing card 1. At the moment when the flipping plate 20 is turned over, the playing card 1 is affected by the centrifugal force and has the force of being thrown outwards. At this time, the guide slope 211 is configured to restrict the playing card 1 from being thrown out and to guide the playing card 1 to enter the tray 30, so as to ensure stable reception. When the flipping plate 20 is turned to the position of the side baffle 212, the trough 21 is adjacent to the lower side of the guide slope 211. When the trough 21 is turned at an angle of inclination, the playing card 1 can be prevented from sliding out from the bottom. Furthermore, when the tray 30 is pushed by the second push arm 283 to be pivoted upwards at the predetermined angle, the positioning protrusion 302 of the tray 30 will be in contact with the stop protrusion 203 to stop further turning of the tray 30, so that the tray 30 is positioned at the predetermined angle to receive the playing card 1.

Next, the motor 15 drives the turning disc 14 to rotate again. The turning disc 14 rotates about half a circle again, that is, the connecting lever 26 is pulled back by the pivot pin 142 to the bottom dead center again, and the protruding portion 141 is returned to the position corresponding to the proximity switch 16. At this time, the proximity switch 16 senses that the turning disc 14 has rotated a circle, and makes the motor 15 stop driving the turning disc 14. In this process, the flipping plate 20 is pulled down with the plate shaft portion 201 as a rotating shaft to be in a horizontal state. The first push handle 27 and the second push handle 28 are returned downwards along with the turning disc 20. At this time, the first connecting rod 17 makes the first drive arm 272 produce a reverse thrust, and then the first push handle 27 is rotated counterclockwise, so that the first push arm 273 is retracted to the bottom of the flipping plate 20. At the same time, the second connecting rod 18 makes the second drive arm 282 produce a reverse thrust, and then the second push handle 28 is rotated clockwise, so that the second push arm 283 is retracted to the bottom of the flipping plate 20. The plate shaft portion 301 of the tray 30 serves as the rotating shaft, and the tray 30 is returned to be in a horizontal sate and attached to the flipping plate 20, that is, the tray 30 is returned to be in the initial state. In this way, the playing card 1 in the trough 21 is flipped, by 180 degrees, to be in the tray 30, so as to correct the playing card automatically, without any manual operation.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A flip-over mechanism, comprising: a frame, including a horizontal plate and a turning disc under the horizontal plate, the turning disc being driven to rotate by an external power, the turning disc having a shaft pin on a periphery thereof; a pair of pivot ears being provided on one side of the frame, one end of a first connecting rod and one end of a second connecting rod being pivotally connected to the horizontal plate, respectively; a flipping plate, including a plate shaft portion on one side thereof, a pair of shaft seats, and a trough; the plate shaft portion being pivotally connected to the pair of pivot ears, the trough being located at one side of the pair of shaft seats away from the plate shaft portion and configured for receiving a playing card, a slot being defined in the trough, the flipping plate having a through hole between the plate shaft portion and the pair of shaft seats; a connecting seat and a pivot seat being coupled to an underside of the flipping plate, one end of a connecting lever being pivotally connected to the connecting set, another end of the connecting lever being pivotally connected to the shaft pin of the turning disc; a first push handle and a second push handle being pivotally connected to the pivot seat; the first push handle having a first push arm facing the slot, the first push handle being driven by another end of the first connecting rod to pivot the first push arm; the second push handle having a second push arm facing the through hole, the second push handle being driven by another end of the second connecting rod to pivot the second push arm; a tray, including a tray shaft portion on one side thereof, the tray shaft portion being pivotally connected to the pair of shaft seats; wherein the turning disc is driven to rotate for the connecting lever to push the flipping plate to turn upwards, the first push arm is driven by the first connecting rod to pass through the slot and push the playing card, and the second push arm is driven by the second connecting rod to pass through the through hole and push the tray to turn upwards, such that the playing card is pushed into the tray.

2. The flip-over mechanism as claimed in claim 1, wherein a vertical fixing base is provided under the horizontal plate; wherein a motor and a proximity switch are coupled to the vertical fixing base and configured to drive the turning disc to rotate.

3. The flip-over mechanism as claimed in claim 2, wherein the periphery of the turning disc has a protruding portion, and the protruding portion is turned to be aligned with or not to be aligned with the proximity switch along with rotation of the turning disc, so as to control rotation of the turning disc.

4. The flip-over mechanism as claimed in claim 1, wherein an included angle is formed between axial extension lines of the plate shaft portion and the tray shaft portion.

5. The flip-over mechanism as claimed in claim 4, wherein a guide slope is provided on one side of the trough, away from the pair of shaft seats, a side baffle is provided on one side of the flipping plate, adjacent to the guide slope.

6. The flip-over mechanism as claimed in claim 1, wherein a stop protrusion is provided between the pair of shaft seats and the trough, a positioning protrusion is provided close to one side of the tray shaft portion and corresponds to the stop protrusion, and the positioning protrusion is configured to be in contact with the stop protrusion so that the tray is pivoted and positioned at a predetermined angle.

7. The flip-over mechanism as claimed in claim 1, wherein the first push handle has a first fulcrum portion that is pivotally connected to the pivot seat, a first drive arm on one side of the first fulcrum portion, and the first push arm on another side of the first fulcrum portion; an outer end of the first drive arm is pivotally connected to the another end of the first connecting rod; the second push handle has a second fulcrum portion that is pivotally connected to the pivot seat, a second drive arm on one side of the second fulcrum portion, and the second push arm on another side of the second fulcrum portion; an outer end of the second drive arm is pivotally connected to the another end of the second connecting rod.

8. The flip-over mechanism as claimed in claim 7, wherein the pivot seat is in an inverted "U" shape, the pivot seat has a first pivot portion on one side thereof and a second pivot portion on an opposing side thereof, the first pivot portion is pivotally connected to the first fulcrum portion, and the second pivot portion is pivotally connected to the second fulcrum portion.

9. The flip-over mechanism as claimed in claim 7, wherein each of the first push arm and the second push arm is in the form of an arc hook having one end portion tilted upwardly.

10. The flip-over mechanism as claimed in claim 9, wherein the end portions of the first push arm and the second push arm are pushed upwardly in different directions, a pivotal position of the first connecting rod and the first drive arm is higher in height than the first fulcrum portion, and a pivotal position of the second connecting rod and the second drive arm is lower in height than the second fulcrum portion.

* * * * *